US006499164B1

(12) United States Patent
Leach

(10) Patent No.: US 6,499,164 B1
(45) Date of Patent: Dec. 31, 2002

(54) BODY PILLOW WITH HORSESHOE-SHAPED TOP AND J-SHAPED BOTTOM

(76) Inventor: Jamie S. Leach, 130 E. 10th St., P.O. Box 717, Ada, OK (US) 74820

( * ) Notice: Subject to any disclaimer, the term of this patent is extended or adjusted under 35 U.S.C. 154(b) by 42 days.

(21) Appl. No.: 09/691,989

(22) Filed: Oct. 19, 2000

(51) Int. Cl.[7] ..... A47G 9/00
(52) U.S. Cl. ..... 5/632; 5/630; 5/652
(58) Field of Search ..... 5/632, 630, 636, 5/645, 652

(56) References Cited

U.S. PATENT DOCUMENTS

D201,492 S * 6/1965 Jacobson ..... D6/601
4,624,021 A * 11/1986 Hofstetter ..... 5/632
5,097,551 A * 3/1992 Smith ..... 5/652
5,519,906 A * 5/1996 Fanto-Chan ..... 5/631
5,581,833 A 12/1996 Zenoff
D382,435 S * 8/1997 Schaffner et al. ..... D6/596
5,778,470 A * 7/1998 Haider ..... 5/644
5,987,674 A * 11/1999 Schaffner et al. ..... 5/630
6,052,848 A * 4/2000 Kelly ..... 5/630
6,055,687 A 5/2000 Matthews
6,088,854 A 7/2000 Brownrigg

* cited by examiner

*Primary Examiner*—Lynne H. Browne
*Assistant Examiner*—Fredrick Conley
(74) *Attorney, Agent, or Firm*—William S. Dorman

(57) ABSTRACT

A body pillow having an upper end which is essentially in the shape of a horseshoe and a lower end which is essentially in the shape of a J, a straight portion connecting the horseshoe-shaped top with the J-shaped bottom, the cross-sectional diameter of the body pillow being between 7 and 12 inches.

11 Claims, 5 Drawing Sheets

5/5

BODY PILLOW WITH HORSESHOE-SHAPED TOP AND J-SHAPED BOTTOM

BACKGROUND OF THE INVENTION

1. Field of the Invention

The present invention relates to a body pillow. More particularly, the present invention involves a pillow with a horseshoe-shaped top to accommodate the upper portion of a person (head) and a J-shaped bottom for accommodating the lower portion (legs) of the person; in a miniaturized form, a similarly shaped body pillow accommodates the head of a child in the region of the horseshoe-shaped top and accommodates the lower region of the child in the J-shaped portion. For infants, the second embodiment can be secured with ties to form a nest.

2. Prior Art

There are many patents that show or relate to body pillows. Some of the body pillows are designed particularly for infants, some particularly for small children and some especially for adults. It is believe to be novel to provide a pillow with a horseshoe-shaped top and a J-shaped bottom which is particularly designed, in one embodiment, to accommodate an adult and in a second embodiment, to accommodate a small child or even an infant. A preliminary patentability search was conducted on this invention and the following listed references were uncovered in the search.

| Inventor | Patent No. | Date |
|---|---|---|
| Thompson | D-124,296 | Aug. 5, 1940 |
| Jacobson | D-201,492 | Jun. 29, 1965 |
| Lijewski | D-230,804 | Mar. 19, 1974 |
| Phillips | D-303,897 | Oct. 10, 1989 |
| Byrn | D-318,969 | Aug. 13, 1991 |
| Faithfull | D-370,585 | Jun. 11, 1996 |
| Watt | D-377,881 | Feb. 11, 1997 |
| Varaney | 4,173,048 | Nov. 6, 1979 |
| Nakamura | 4,197,604 | Apr. 15, 1980 |
| Hofstetter | 4,624,021 | Nov. 25, 1986 |
| Smith | 5,097,551 | Mar. 24, 1992 |
| McCarty | 5,371,909 | Dec. 13, 1994 |
| Zenoff | 5,581,833 | Dec. 10, 1996 |
| Matthews | 5,661,861 | Sep. 2, 1997 |
| Akey | 5,978,990 | Nov. 9, 1999 |
| Schaffner et al. | 5,987,674 | Nov. 23, 1999 |
| Kelly | 6,052,848 | Apr. 25, 2000 |
| Matthews | 6,055,687 | May 2, 2000 |
| Brownrigg | 6,088,854 | Jul. 18, 2000 |

The above patents are not considered to be particularly pertinent to the present invention. However, Brownrigg U.S. Pat. No. 6,088,854 discloses a pillow that appears to be almost as long as a persons body but it seems to be ultra flexible and whether or not tucking one part of it between the legs will satisfy the cooling feature of the present invention is questionable. In column 3, lines 20 through 26 of the Brownrigg patent, it says that one embodiment involves blowing between 48 to 56 and 58 ounces of polyester fiber into a 100 inch lateral body supporting pillow having a diameter of 4.5 inches. The preferred embodiment involves blowing 42 to 46 ounces of a polymer into a 78 inch lateral body supporting pillow having a diameter of 4.5 inches.

The Matthews U.S. Pat. No. 6,055,687 is simply a horseshoe-shaped pillow with an animals head attached to one end.

The Zenoff U.S. Pat. No. 5,581,833 shows a support pillow shaped to conform to the users body. However, the pillow does not extend for the full length of the body and primarily serves to encircle a portion of the users body.

SUMMARY OF THE INVENTION

A support pillow having a horseshoe-shaped top and a J-shaped bottom connected together by a straight section. Preferably, the diameter of the straight section (this diameter applies to the horseshoe portion and the J-shaped portion as well) is preferably about 8 inches but can be between 6 inches and 12 inches.

With respect to the embodiment that is used for an adult, the length of the straight portion between the upper horseshoe portion and the lower J-shaped portion should be between 48 and 56 inches and is preferably approximately 52 inches. In the smaller version of this body pillow which is used for infants and toddlers, the length of the mid-section should be between 24 and 32 inches and is preferably approximately 28 inches. In the smaller version, ties are provided at the end of the J-shaped portion and near the end of the horseshoe-shaped portion for tying the ends of the pillow together for different formations.

DETAILED DESCRIPTION OF THE PREFERRED EMBODIMENTS

Figure 6:
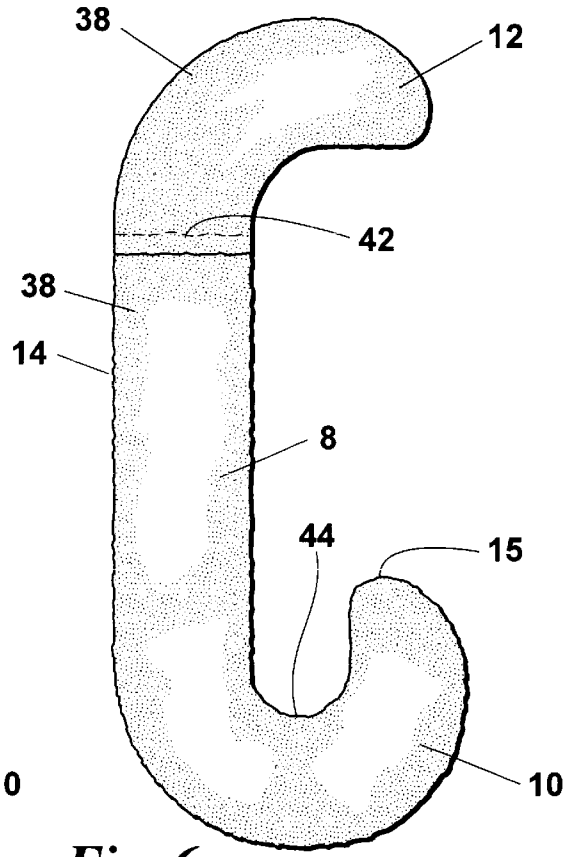
FIG. 6 is a plan view similar to FIG. 5 but showing the J-shaped portion of the cover being completely over the now hidden J-shaped portion of the filled liner.

Referring to the drawings in detail, FIG. 6 shows a body pillow 8 for use in conjunction with an adult. The pillow 8 shown in FIG. 6 is actually upside down with the lower portion shown in this figure actually constituting the top. With this idea in mind that the pillow 8 in FIG. 6 is upside down, we will continue with the description of the pillow. Pillow 8 includes an upper horseshoe-shaped portion 10, a lower J-shaped portion 12 and an elongated mid-section 14 that connects the horseshoe-shaped portion 10 with the J-shaped portion 12.

The body pillow 8 actually includes two members, one inside the other. The inner member (or "liner") 36 is a 100% polyester fabric sheet, 18 gauge, which is adapted to "breath" by allowing air to pass through the interstices of the fabric. The outer member (or "pillowcase") 38 is a sheet of polyester cotton cloth (65/35) which is designed to protect the liner 36 just as a conventional pillowcase protects a conventional pillow.

An opening, or slit, 40 located near the top of the J-shaped portion of the inner member 36 is for the purpose of blowing batting material, such as polyester fiber (not shown), into the interior of this member until it is filled to the desirable size and firmness.

Thereafter, the slit 40 through which the polyester fiber was blown in is sewn together and the pillowcase 38, which is similarly shaped, is slipped over the polyester liner 36 through a slotted opening 42 in the pillowcase. However, a preferred method of placing the liner 36 inside the pillowcase 38 is described immediately below.

Figure 3:
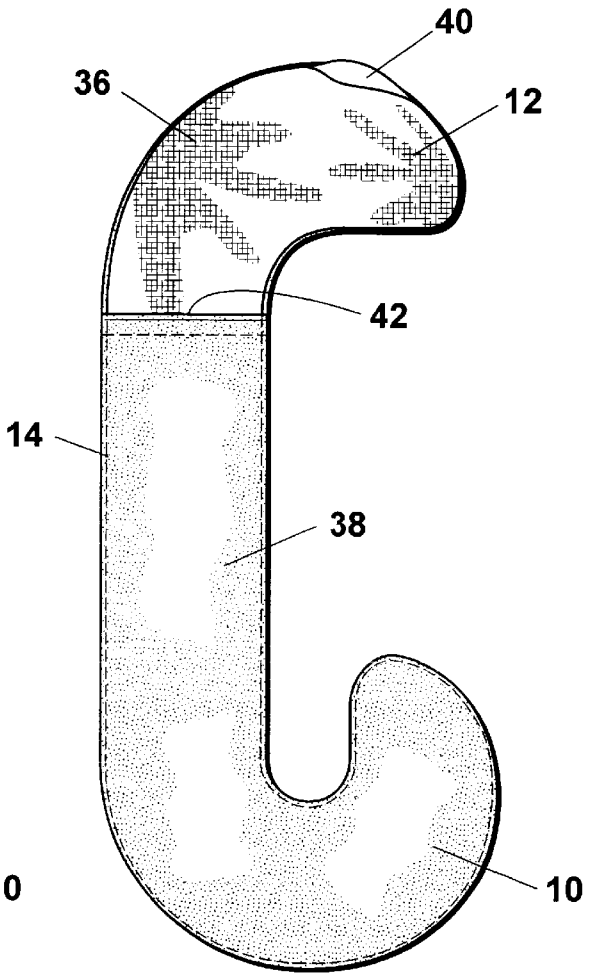
FIG. 3 is a plan view showing the liner in FIG. 1 inserted into the cover of FIG. 2 with only the J-shaped portion of the liner not being inserted in the cover.
Figure 2:
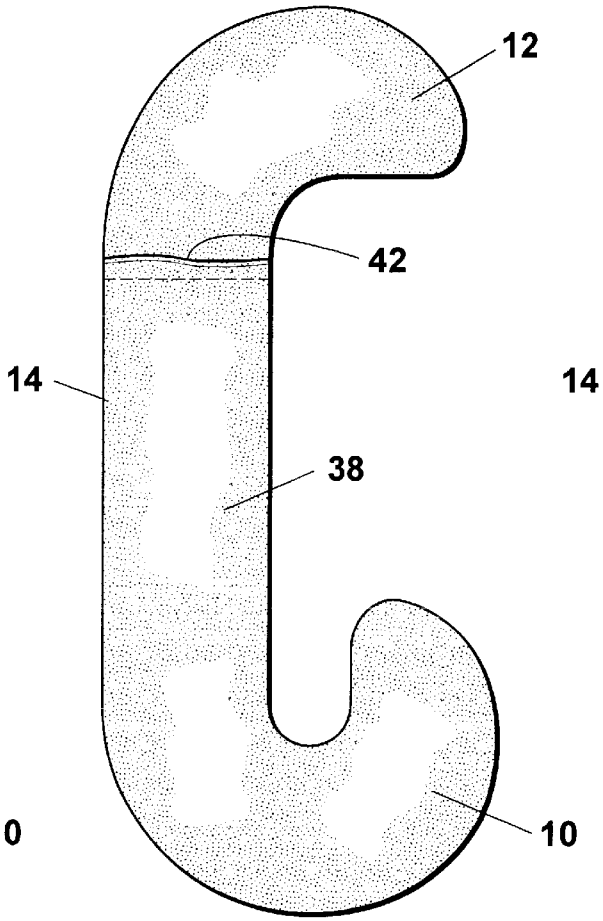
FIG. 2 is a plan view of the cover, also laid flat, as used in the first embodiment of the pillow of the present invention.
Figure 4:
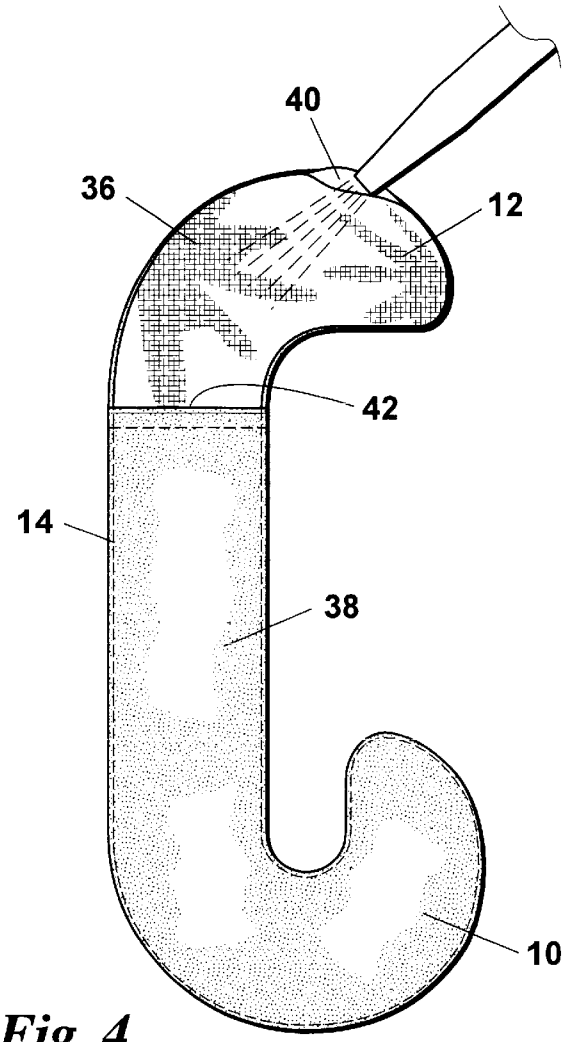
FIG. 4 is a plan view similar to FIG. 3 but showing the liner being filled with polyfill through a gap in the inner liner.
Figure 5:
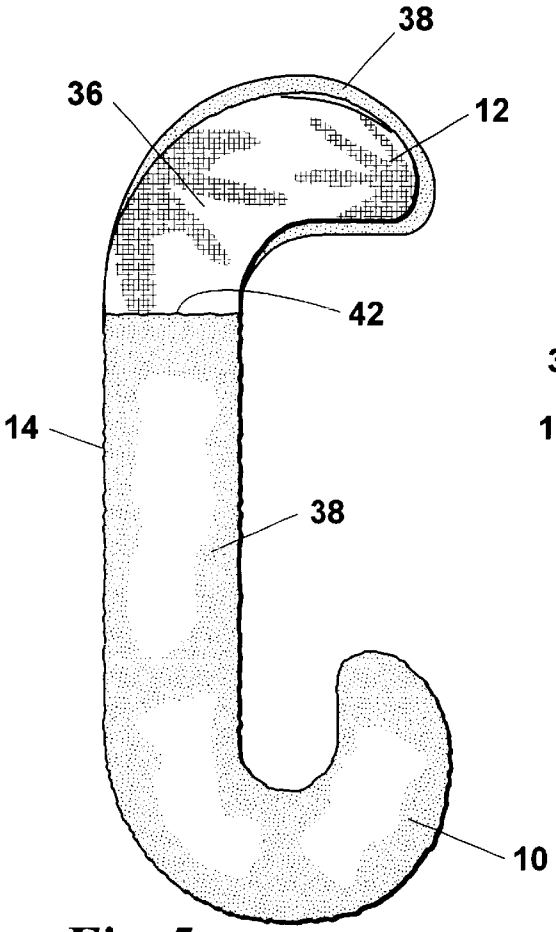
FIG. 5 is a view similar to FIG. 4 but showing the liner filled, the gap sewn shut prior to stuffing the J-shaped portion of the liner into the corresponding portion of the cover.

Rather than have the body 36 filled totally when it is not associated with the pillowcase 38, it is preferable if an unfilled body 36 is tucked the pillowcase 38 into through the slotted opening 42 and the straight section 14, and then into the horseshoe-shaped portion with the J-shaped portion hanging out of the pillowcase through the slotted opening 42 in the pillowcase as best shown in FIG. 3. As indicated heretofore, the liner 36 is provided with an 8 inch slit 40 along the upper edge of its J-shaped portion to permit polyester fibers to be blown into the liner 36 as shown in FIG. 4. The operator will blow fiber into the liner 34 through the slit 40 until the desired degree of fullness and firmness is achieved. After the liner 36 has been filled to the point of satisfaction of the operator, the slit 40 is stitched closed and the upper J-shaped portion (now filled) of the liner 36 is tucked into the J-shaped portion of the pillowcase 38 through the slotted opening 42 as shown in the progression of FIGS. 5 and 6. This method of inserting the filed J-shaped portion only of the liner into the J-shaped portion of the pillowcase 38 is considerably quicker than putting the entire filled liner 36 into the pillowcase 38 through the slotted opening 42.

At the time of introduction of the polyester fiber into the polyester fabric liner 36, both the liner 36 and the pillowcase 38 will be lying flat on some suitable surface, as best shown in FIGS. 1 to 6. Both the liner 36 and the pillowcase 38 are stitched along their outer edges so as to form an essentially closed cavity. However, the pillowcase 38 is provided with a transverse slotted opening 42, as indicated above. The slotted opening 42 is located where the straight body portion 14 connects with the J-shaped portion of the body 38. Each body will measure approximately 11 to 11½ inches from side to side. Both the liner 36 and the pillowcase 38 are cut and stitched to provide the horseshoe-shape 10 at the top and the J-shaped 12 at the bottom.

Figure 7:
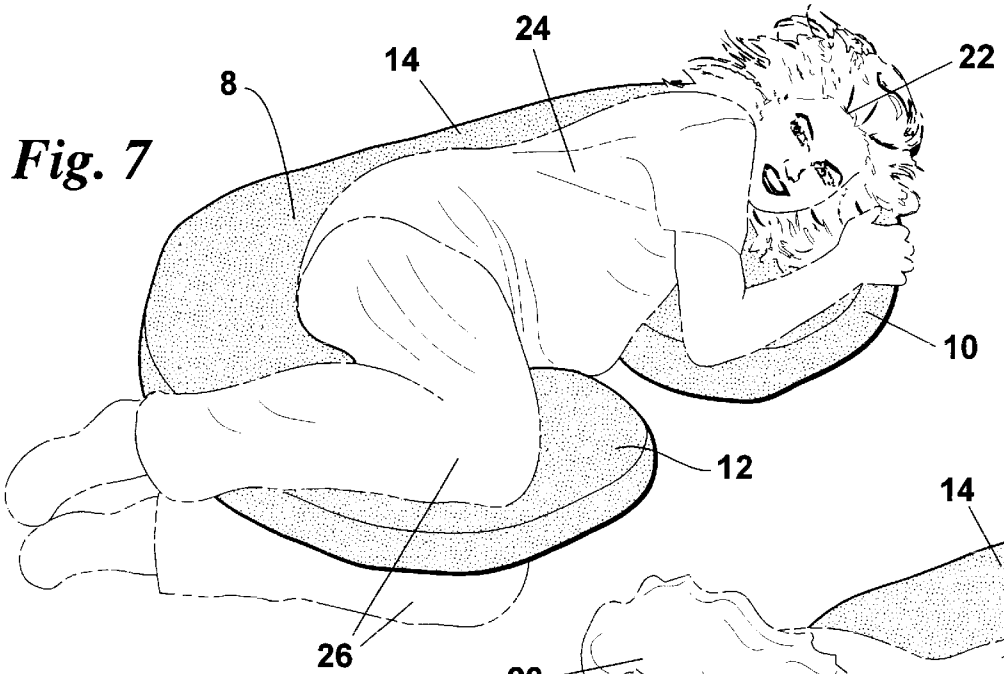
FIG. 7 is a perspective view of the pillow of FIG. 6 showing a woman resting her head on the horseshoe-shaped portion with the J-shaped portion being located between her legs.
Figure 8:
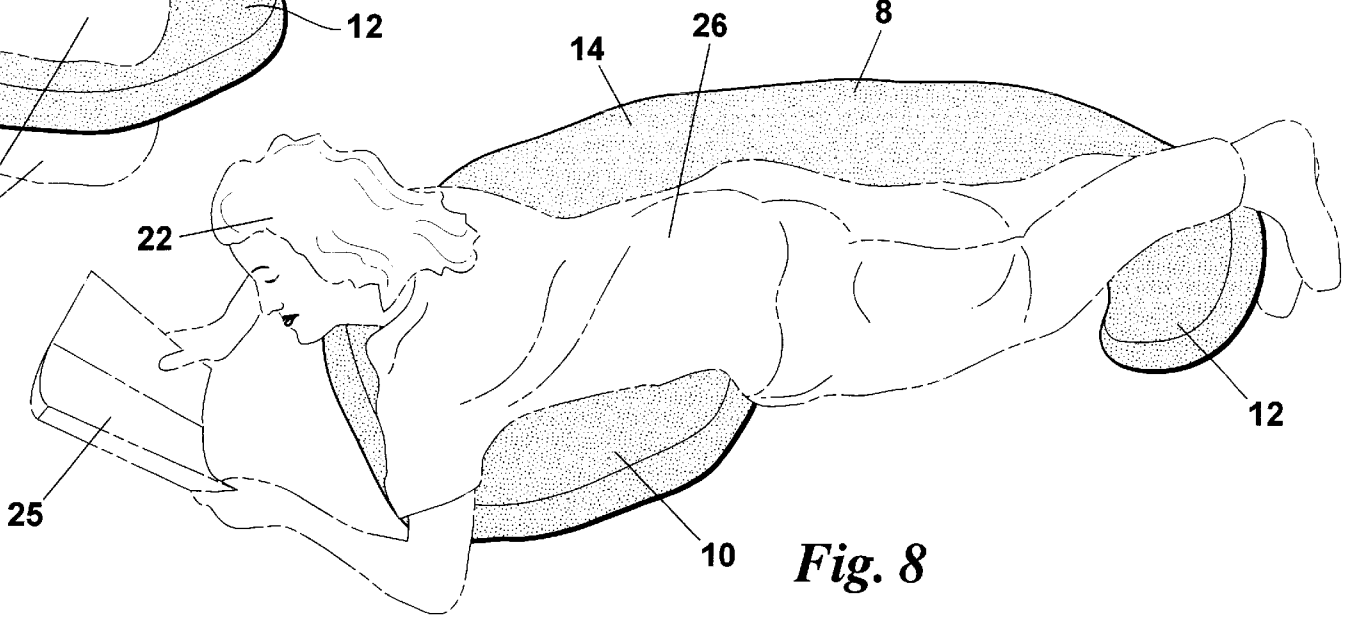
FIGS. 8 is a perspective view of an adult woman lying on her stomach over the pillow of FIG. 6 and where the head is sufficiently elevated so that she can read a book.

As best shown in FIG. 7, the head 22 of an adult female 24, lying on her side, is adapted to rest against the horseshoe-shaped portion 10. Also, the J-shaped portion 12 is shown as received between the legs 26 of the adult female. As shown in FIG. 8 the female 24 is lying prone, on her stomach, across the pillow 8 with her head 22 sufficiently elevated so that she can read a book 25.

As shown in FIG. 7, the female 24 is indicated as pregnant so that the J-shaped portion 12 which goes between the legs 26 provides for temperature control. It is understood that pregnant women find it desirable at times to keep a space between their legs so as to alleviate the heat which would otherwise occur if the legs were kept together.

Figure 1:
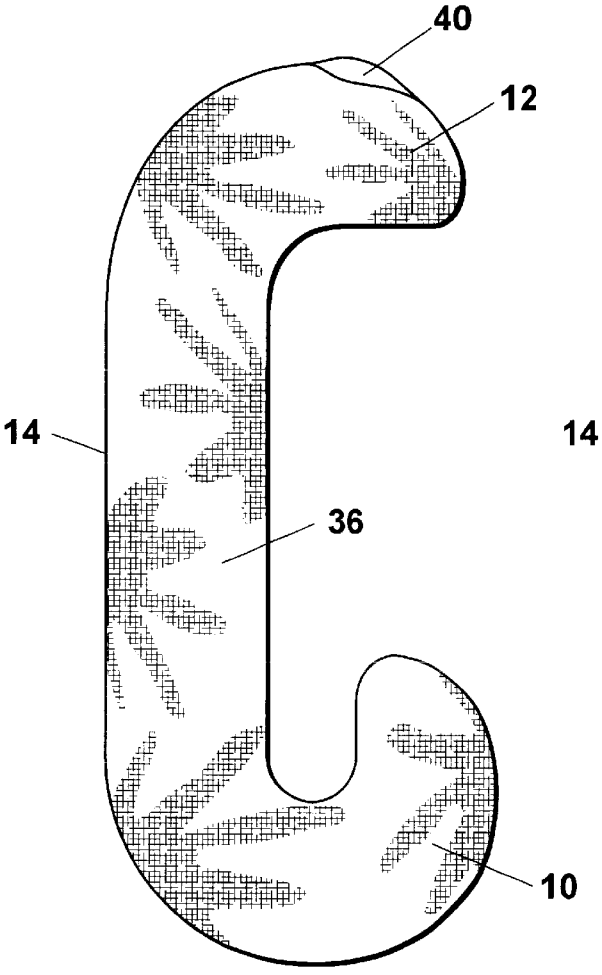
FIG. 1 is a plan view of the fillable but empty liner, laid flat, as used in a first embodiment of the pillow of the present invention.
Figure 9:
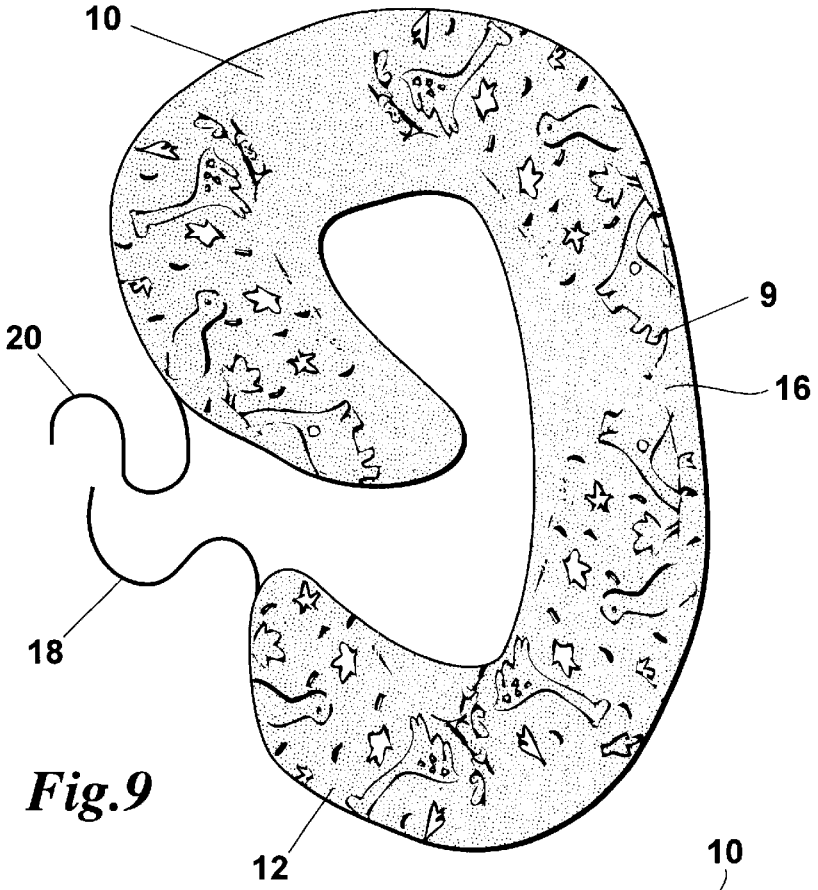
FIG. 9 is a plan view of a second embodiment of the present invention wherein the pillow is similarly shaped but the mid-section which connects the horseshoe-shaped portion with the J-shaped portion is shorter than in the embodiment of FIG. 6, and wherein ties are further located at the end of the J-shaped portion and mid-way of the horseshoe-shaped portion to permit tying and pulling in the ends of the pillow.
Figure 10:
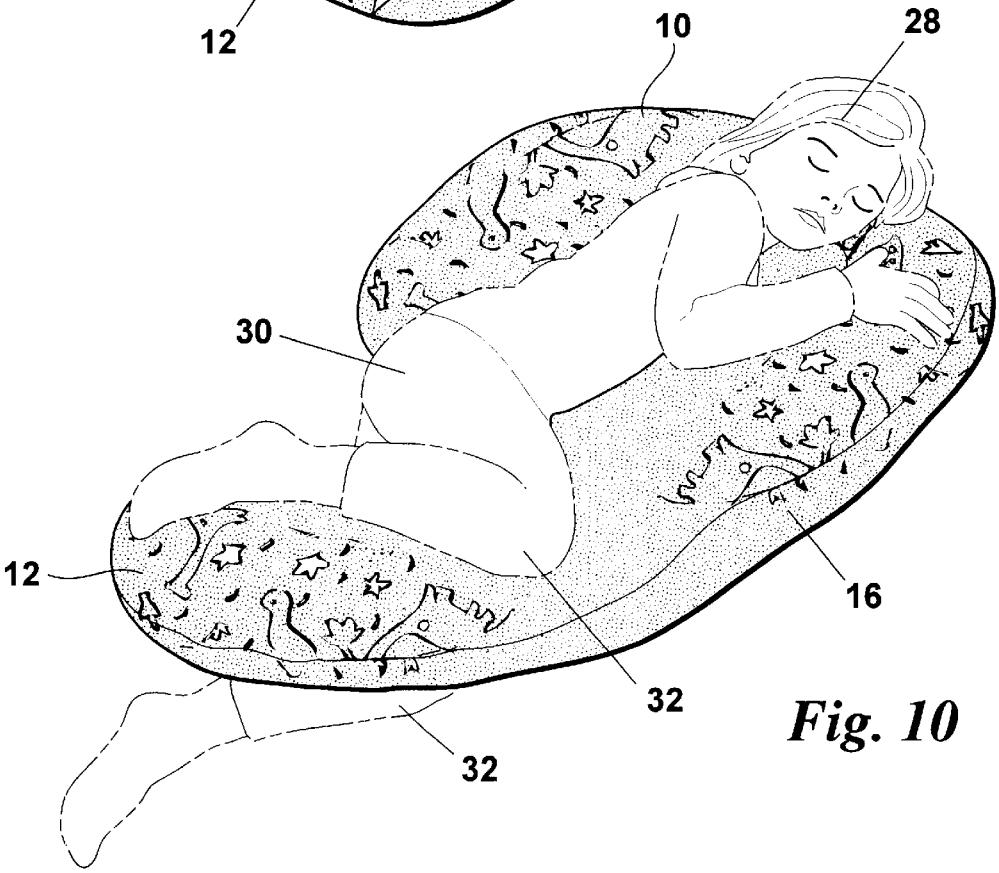
FIG. 10 is a perspective view showing a young girl sleeping on the pillow of FIG. 9.

As shown in FIG. 9, a pillow 9 which is a miniaturization (at least as far as length is concerned) of the pillow 8 shown in FIG. 1 includes the same horseshoe-shaped top portion 10 and the lower J-shaped portion 12. However, the interconnecting mid-section 16 in FIG. 9 which connects the horseshoe-shaped portion 10 with the J-shaped portion 12 is of lesser length than the mid-section 14 of FIG. 6. Also, there is a tie 18 at the end of the J-shaped portion 12 and another tie 20 midway between the upper and lower ends of the horseshoe-shaped head portion 10. As best shown in FIG. 10, the head 28 of a child 30 is shown resting on the horseshoe-shaped portion 10 whereas the J-shaped portion 12 of the pillow 9 is going between the legs 32 of the child.

Figure 11:
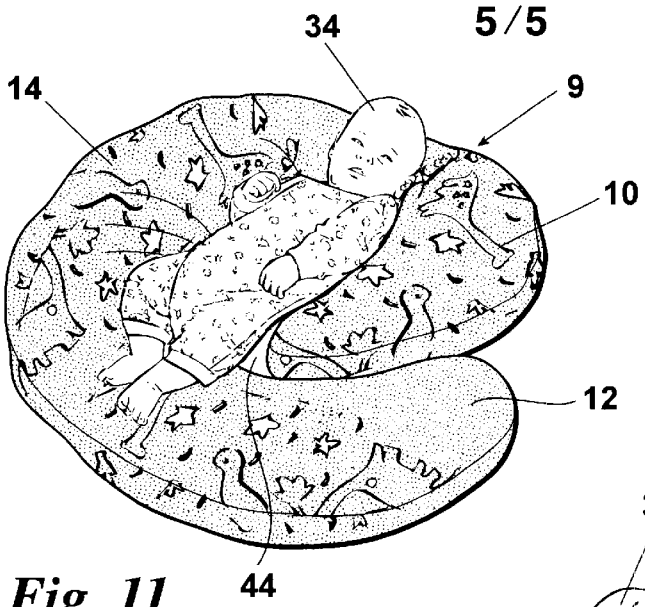
FIG. 11 is a perspective view of the pillow of FIG. 9 in a closed position brought about by tying together the ties and showing an infant lying across the top of the pillow.
Figure 13:
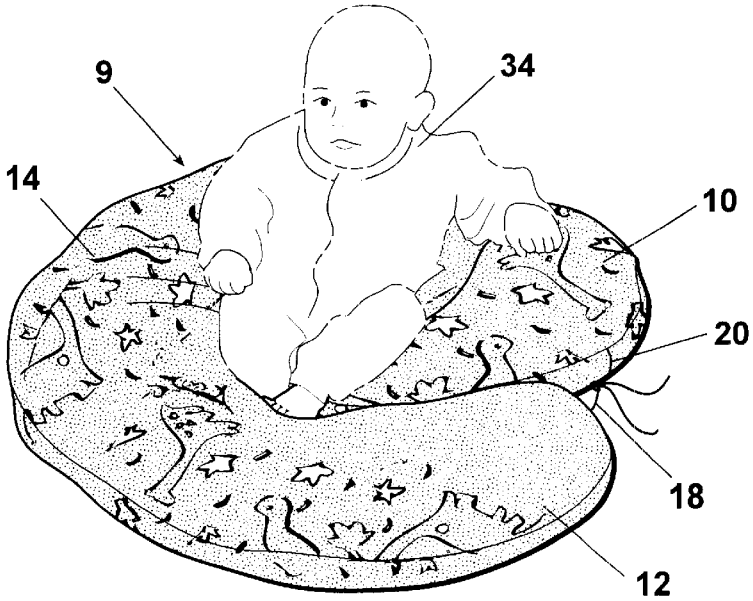
FIG. 13 is a perspective view of a baby sitting up in the pillow of FIG. 9 with the ties being slightly loosened as compared to FIG. 11.

When it is desired to connect the ties together, the tie 18 is pulled upwardly towards the tie 20 and a knot is made so as to produce the nesting effect shown in FIG. 8. As best shown in FIG. 11 an infant 34 can lay on the upper portion of the pillow with his buttocks and hips resting in the resulting central opening 44 created by the tying in of the upper horseshoe-portion to the lower J-shaped portion. When the center opening 44 for the pillow 9 is tied and closed this opening will measure about 8" high by 6" wide, principally for newborn and small infants. For older infants where the ties 18 and 20 are loosely tied the size of the central opening 44 will be about 12" longitudinally by about 7" wide. Thus, FIG. 13 shows a larger and older infant 34 sitting within the central opening 44 which is larger than the central opening 44 in FIG. 11, because the ties 18 and 20 are loosely tied.

Whereas, the smaller pillow 9 has been described above in connection with ties 18 and 20 which not only pull the J-shaped portion toward the horseshoe-shaped portion, but also can effect a variable size of central opening, nevertheless, these ties 18 and 20 could be replaced with velcro strips (not shown) which could be attached to the horseshoe-shaped portion and the J-shaped portion, respectively, at the locations where the ties 18 and 20 are connected. This will permit a connection of the J-shaped portion to the horseshoe-shaped portion in an adjustable manner. Also, a plurality of snaps could be employed at these locations to provide a similar adjustable connection between the horseshoe-shaped portion and the J-shaped portion. Thus, where the term "tie" or "ties" occurs it should be understood that this particular expression should be considered as covering other means of adjustably connecting one portion of the pillow 9 to the other portion in an adjustable manner, such as velcro or snaps.

Figure 12:
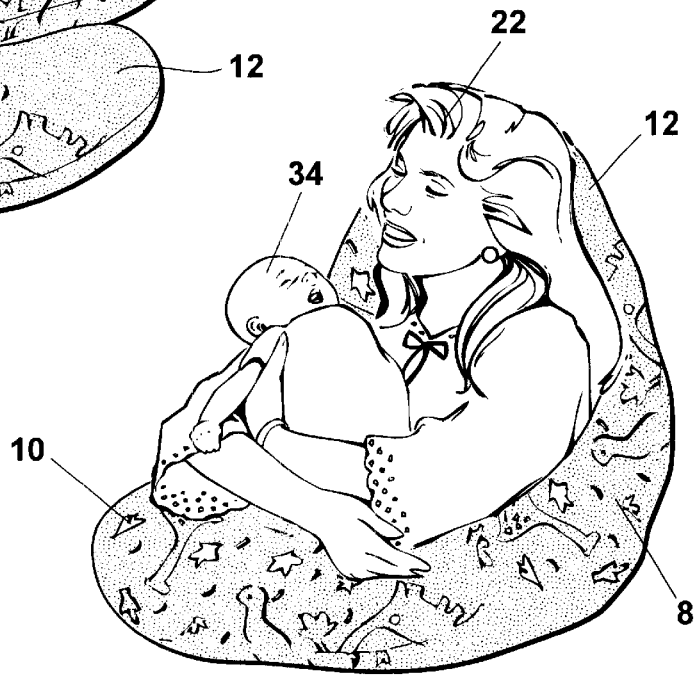
FIG. 12 is a perspective view of an adult woman cradling an infant in her arms while using the pillow of FIG. 6 with the J-shaped portion thereof being behind her neck and the horseshoe-shaped portion thereof being around her waist.

FIG. 12 shows another use for the larger pillow 8. This Figure shows an adult woman 22 cradling an infant 34 in her arms while using the pillow of FIG. 6 with the J-shaped portion thereof being behind her neck and the horseshoe-shaped portion thereof being around her waist.

As indicated above, when the forms for the pillow 8 are lying flat as shown in FIGS. 1 to 4, the side to side dimension is approximately 11 to 11 and one half inches. When the inner liner 34 is inserted into the pillowcase 36, as shown in FIG. 3, and the inner member 34 is filled with the polyester fiber through the slit 40, as shown in FIG. 4 the sides will come closer together and the top of the straight section 14 will be raised above the bottom. With respect to the straight section 14, which as indicated heretofore, is nearly cylindrical; actually, the top of section 14 will be slightly closer to the bottom than the side to side dimension. Nevertheless, the circumference will be always approximately 23 inches. With the desired of degree of firmness for the pillow 8, the horseshoe-shaped portion 10 will be somewhat flatter, with the top portion thereof being separated from the bottom portion thereof less than in the section 14. This means that the J-shaped portion is wider in the horizontal direction than the height. The same considerations hold true for the J-shaped portion 12 at the opposite end of the pillow 8. The upper portion of the horseshoe-shaped portion 10 actually constitutes a semi-toroidal member having a diameter of about 25 to 26 inches. With respect to the center portion of the horseshoe-shaped portion 10 between the lower foot 15 thereof, the opening 44 is fairly small and tight as contrasted with the larger opening or curvature 46 where the straight section 14 curves into the J-shaped portion 12. A best shown in FIG. 6, the foot 15 extends parallel to the straight portion 14 and forms therewith the curved opening 44.

As far as the materials are concerned, that is the materials used in the various elements referred to above, the inner lining 36 has been described as being a 100% polyester fabric, but of course any suitable material which would form a breathable liner would suffice. Preferably, however, the liner 36 is a 100% polyester fabric having a preferred thickness of about 18 gauge and a weight of approximately 3.75 oz./sq. yd. Any equivalent material could be used instead.

With respect to the pillowcase 38, this could be cotton or polyester cotton. Although many equivalents could be selected, purely for purposes of example the pillowcase used in the embodiment of FIGS. 1 to 8 is ivory colored polyester/cotton (65% polyester, 35% cotton) having a thread count per square inch=110×96 and a weight of 2.5 ounces per square yard.

The smaller pillow 9 does not have an inner liner and an outer pillowcase in the embodiment shown, but it could be made that way if desired following the teachings regarding the pillow 8. Preferably, the smaller pillow 9 is a single layer of 100% cotton, 68×68 threads per inch, yarn size 30/1's, and having a weight of about 3.5 ounces per square yard. The cloth is preferably multi-colored and suitably decorated for infants and toddlers.

As far as the filler (not referenced) is concerned, any suitable batting material can be used in the filling of the liner 36 or the pillow 9. Matthews U.S. Pat. No. 6,055,687 describes, column 6, lines 4 to 19, several batting compositions which might be suitable. Varaney U.S. Pat. No. 4,173,048 describes, column 3, line 31 to 62, various embodiments of batting. Nakamura U.S. Pat. No. 4,197,604 describes, column 1, lines 44 to 52, various batting or "wadding" materials. Brownrigg U.S. Pat. No. 6,088,854 describes, column 3, lines 5 to 13, several suitable fillers. Schaffner et al. U.S. Pat. No. 5,987,674 describes, column 4, lines 2 to 6, suitable fill materials. In the present case, although other types of fillers may be used, purely for purpose of example, the filler used is a polyester fiber.

Whereas the present invention has been described in particular relation to the drawings attached hereto, it should be apparent that other and further modifications of the present invention, apart from those shown or suggested herein, may be made within the spirit and scope of this invention.

What is claimed is:

1. A body pillow having a top which is essentially in the shape of a horseshoe for accommodating an upper end of a person and a bottom which is essentially in the shape of a J for accommodating a lower end of the person, a substantially cylindrical straight portion connecting the horseshoe-shaped top with the J-shaped bottom, the cross-sectional diameter of the body pillow being between 7 and 12 inches, the horseshoe shaped top constituting a semi-toroidal member having a diameter of about 25 to 26 inches and terminating in a foot spaced from the straight portion extending parallel to the straight portion and forming therewith a curved opening.

2. A body pillow as set forth in claim 1 wherein the straight portion connecting the horseshoe-shaped top with the J-shaped bottom has a length which is approximately 48 to 56 inches.

3. A body pillow as set forth in claim 2 wherein the head of an adult female, lying on her side, is adapted to rest against the horseshoe-shaped top and wherein the J-shaped bottom is received between the legs of the adult female.

4. A body pillow as set forth in claim 2 wherein the pillow is comprised of an inner polyester liner and an outer cloth pillowcase, the liner and pillowcase conforming to the shape of the pillow.

5. A body pillow as set forth in claim 4 wherein the liner is proved with a slit along the J-shaped bottom of the liner to permit the introduction of filler material into the interior of the liner and wherein the pillowcase is provided with a slotted opening through which the liner can be inserted.

6. A body pillow as set forth in claim 5 wherein the liner is inserted into the slotted opening in the pillowcase prior to the introduction of filler material into the liner until the horseshoe-shaped portion of the liner is fully received within the horseshoe-shaped top of the pillowcase, with the J-shaped bottom of the liner lying over and external of the J-shaped bottom of the pillowcase, whereby the liner can be filled with filler material through the slit therein, the slit can be sewn together, and the now-filled J-shaped bottom of the liner can be inserted into the J-shaped bottom of the pillowcase through the slotted opening.

7. A body pillow as set forth in claim 1 wherein the straight portion connecting the horseshoe-shaped top with the J-shaped bottom has a length which is approximately 24 to 32 inches.

8. A body pillow as set forth in claim 7 wherein the head of a child is adapted to rest on the horseshoe-shaped top whereas the J-shaped of the pillow is received between the legs of the child.

9. A body pillow as set forth in claim 9 wherein a first tie is located at an end of the J-shaped portion and a second tie is located on the foot of the horseshoe-shaped portion in spaced relation with the first tie, whereby the ties can be pulled toward each other and tied together so that the J-shaped bottom is brought closer to the horseshoe-shaped top.

10. A body pillow as set forth in claim 9 wherein the ties are pulled toward each other and a knot is made so as to produce a nest having a central opening whereby an infant can lay on the pillow with his buttocks and hips resting in the central opening.

11. A body pillow as set forth in claim 9 wherein the ties are loosely tied to produce a larger central opening and wherein an older infant can sit within the central opening.

* * * * *